US005137190A

United States Patent [19]

Plaud

[11] Patent Number: 5,137,190

[45] Date of Patent: Aug. 11, 1992

[54] APPARATUS FOR FORMING PLEATS AND THE LIKE IN FABRIC STRUCTURES

[75] Inventor: Eugene Plaud, New Bedford, Mass.

[73] Assignee: CHF Industries, New Bedford, Mass.

[21] Appl. No.: 804,103

[22] Filed: Dec. 6, 1991

[51] Int. Cl.[5] ..... A41H 33/00

[52] U.S. Cl. ..... 223/33; 223/34; 223/28; 223/38

[58] Field of Search ..... 223/33, 28, 29, 30, 223/31, 34, 37, 38; 26/21; 112/147, 145, 144, 427, 132; 493/408, 409, 411, 413, 417, 429, 425

[56] References Cited

U.S. PATENT DOCUMENTS

| | | | |
|---|---|---|---|
| 187,229 | 2/1877 | Nickerson et al. | 223/33 |
| 836,322 | 11/1906 | Holmes | 223/33 |
| 1,231,139 | 6/1917 | Dickman | 223/33 |
| 1,657,551 | 1/1928 | Schremp | 223/37 |
| 1,793,769 | 2/1931 | Angelus | 223/33 |
| 3,132,686 | 5/1964 | Judovits | 223/30 X |
| 3,333,559 | 8/1967 | Benz | 223/30 X |
| 4,157,775 | 6/1979 | Soto | 223/34 |
| 4,198,202 | 4/1980 | Kleber | 223/33 |

*Primary Examiner*—Werner H. Schroeder
*Assistant Examiner*—Bibhu Mohanty
*Attorney, Agent, or Firm*—Lockwood, Alex, Fitzgibbon & Cummings

[57] ABSTRACT

An apparatus and method for forming parallel and non-parallel pleats in a fabric structure such as a curtain or drape includes a generally planar baseplate and a segmented forming member hingedly attached thereto and overlying the baseplate. The segmented forming member includes a first template and at least one second template which are hingedly connected together, each of the first and second templates having a leading edge and a trailing edge wherein the first template trailing edge is hingedly connected to the baseplate and wherein the second template trailing edge is hingedly connected to the first template such that a portion of the second template overlies a portion of the first template and such that the first template leading edge and such that a pocket a fabric-forming pocket is defines between the first template leading edge and the second template trailing edge. In forming a pleated fabric structure, a piece of fabric is placed onto the baseplate in alignment with and aligned with a first alignment edge thereof and the first template of the segmented forming member is folded over the fabric. The fabric is then formed folded up over the first template leading edge and into the pocket formed between the first and second templates. The fabric is folded for a second time along the second template trailing edge portion of the pocket and second template is folded on top of the fabric fold and the pleats so formed are sewn together. The baseplate may include a cutoff portion where the folded fabric, or pleats, maybe stitched together. After stitching, the fabric structure can be easily pulled away from the space between the segmented forming member and the baseplate.

24 Claims, 5 Drawing Sheets

APPARATUS FOR FORMING PLEATS AND THE LIKE IN FABRIC STRUCTURES

BACKGROUND AND SUMMARY OF THE PRESENT INVENTION

The present invention generally relates to the forming of pleats, folds or the like in fabrics and more specifically relates to an apparatus and method in forming pleats, folds, tucks and the like of either a parallel or non-parallel character in fabric structures such as draperies, valences and the like.

Fabric structures such as draperies valences and the like are used to decorate windows, canopy bed frames and other interior elements to provide a house with a definitive statement of interior design. One attractive aspect of these fabric structures is that they all typically possess a number of pleats, folds, and/or tucks wherein the fabric is folded upon itself. To maintain uniformity in a fabric structure such as a window treatment, it is desirable to create pleats or folds in the fabric structure that are uniform either within a single fabric structure or as between separate fabric structures. It is therefore desirable to achieve uniform folds or pleats so that the fabric structure is attractive. It is further desirable to attain uniformity of production of certain fabric structures, such as window valences which have a disposition of non-parallel pleats about a central axis because such pleat arrangements are tedious to perform by hand.

The present invention is therefore directed to a device which accurately and uniformly measures pleat width from structure to structure, thereby permitting efficient and uniform production of parallel and non-parallel pleated fabric structures.

One aspect of the present invention is directed to an apparatus for use with the forming of parallel and non-parallel tucks, folds or the like in fabric structures. In this regard, a generally rigid base is provided having a flexible, segmented forming member flexibly attached thereto. An alignment edge defined in the base member provides a reference point against which an edge portion of fabric may be aligned. The segmented forming member includes a plurality of individual plate members, or templates, which are flexibly interconnected in an overlying fashion such that adjacent templates overlie a portion of a preceding template and a portion of the base member, thereby defining "pockets" between adjacent templates. These pockets each receive a predetermined fabric extent, while the fabric is held within the pockets of the apparatus by the templates while a projecting edge of the fabric is stitched to hold the pleats or folds in place. The templates are a pliable, yet rigid material, which can easily be cut to define various predetermined pleat, fold or tuck widths in the resultant fabric structures which will remain uniform with all subsequent fabric structures formed with the device. The templates may also be provided with alignment edges which are aligned with a like alignment edge of the base member during assembly of the segmented forming member.

Another aspect of the present invention pertains to a method of forming pleats, folds, tucks and the like in fabric structures by providing an apparatus having a baseplate and a segmented cover plate having a plurality of interconnected forming plates. A length of fabric is aligned with a baseplate alignment edge and the first forming plate is folded over the fabric. The fabric is folded over the exposed, or trailing edge, of the first forming plate up to the leading edge of the second forming plate overlying the first forming plate. At this leading edge, the fabric is folded upon itself along a foldline coincident with the second forming plate leading edge. and the second forming plate is folded over and onto the folded fabric, to thereby expose the second forming plate trailing edge. The fabric is then folded up and over the next exposed trailing edge and onto the second forming plate, up to the leading edge of the next overlying forming plate. The folding steps previously recited are repeated until the last forming plate is reached, whereupon the exposed open ends of the fabric structure are stitched together. After the fabric is stitched together, the fabric structure can be easily pulled sideways so that the folds or pleats leave the pockets defined in the segmented forming member.

It is therefore an object of the present invention to provide an apparatus for use in the forming of folds, pleats, tucks or the like in fabric structures wherein the apparatus includes a base member and a segmented forming member overlying the base member in which the segmented forming member is flexibly interconnected to the base member.

Another object of the present invention is to provide an apparatus for use in holding a fabric in place during the forming symmetrical or non-symmetrical folds, tucks, pleats or the like in fabric structures such as curtains, draperies, garments or similar soft goods which possess an array of such folds, tucks or pleats, in which the apparatus includes a generally planar baseplate and a segmented forming member flexibly connected thereto, the forming member including at least first and second generally planar templates, the first template being hingedly connected to the base member and overlying a portion thereby, the second template being hingedly connected to the first template such that a portion of the second template overlies a portion of the first template and another portion of the second template overlies a portion of the base member, each of the first and second templates having distinct leading and trailing edges, the trailing edges thereof defining guide means for folding the fabric upon one of the templates and the leading edges thereof defining guide means for folding the fabric upon itself.

It is a further object of the present invention to provide a fabric holding device for use in the forming of pleats, folds, tucks or the like in fabric structures which device is easily constructed and which device provides uniform and consistent such pleats, folds and tucks in the mass production of such fabric structures.

A yet further object of the present invention is to provide a guide device for forming pleats, folds, tucks or the like in fabrics, which guide device includes a baseplate and a segmented guide means overlying the baseplate, the guide means including a plurality of guide members having opposing first and second guide edges, each of the guide members serving as a distance gauge to define the width or depth of individual pleats, folds or tucks in the fabric structure, the guide members holding the fabric in place so that the pleats, folds or tucks may be stitched.

It is yet another object of the present invention to provide a method in forming pleats, tucks or folds in a fabric, the method including the steps of providing a baseplate having a segmented forming member flexibly connected thereto the forming member including a plurality of templates flexibly connected to each other; placing a predetermined quantity of cloth in a preselected position on the baseplate; folding a first template over onto the fabric; folding the fabric around and onto the first template; folding a second template onto the fabric; folding the fabric around and onto the second template; folding successive templates onto the fabric and folding the fabric into pockets created at the interconnection of the baseplates; stitching the folds in the fabric to set the pleats permanently into the fabric; and removing the fabric from the baseplate and segmented forming member.

These and other objects, features, advantages of the present invention will be clearly understood through a consideration of the following detailed description.

BRIEF DESCRIPTION OF THE DRAWINGS

In the course of this detailed description, reference will be frequently made to the attached drawings in which.

DETAILED DESCRIPTION OF THE PREFERRED EMBODIMENTS

Figure 1:
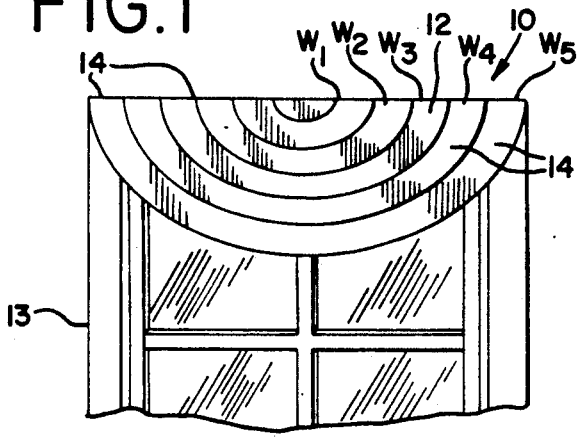
FIG. 1 in an elevational view of a symmetrical, non-parallel valence arrangement easily formed by the present invention.

FIG. 1 illustrates a non-parallel pleated fabric structure, generally 10, such as a window valence 12, in place over a window 13. The valence 12 is seen to be generally symmetrically arranged about a central axis of the window and has a plurality of tucks, folds, or pleats 14 disposed at each end thereof and spanning across the center of the fabric structure 10. The valence 12 possesses a semi-circular configuration and therefore the pleats 14 are generally non-uniform in their width. Each pleat has a varying width, $w_1$–$w_5$.

As will be explained in more specific detail below, the valence 12 may be easily produced using a guide device or apparatus constructed in accordance with the principles of the present invention. The guide device 20, as shown best in FIG. 2, includes a base component, or baseplate 22, to which a cover component, or forming member, 24 is connected to. The base and cover components 22, 24 are preferably formed from a durable or pliable material such as plastic or sheet metal. The forming member 24 is flexibly connected to the baseplate 22 by way of a suitable hinge means 26, such a reinforced adhesive tape, which interconnects the two components along an alignment edge 28 of the baseplate 22.

Figure 2:
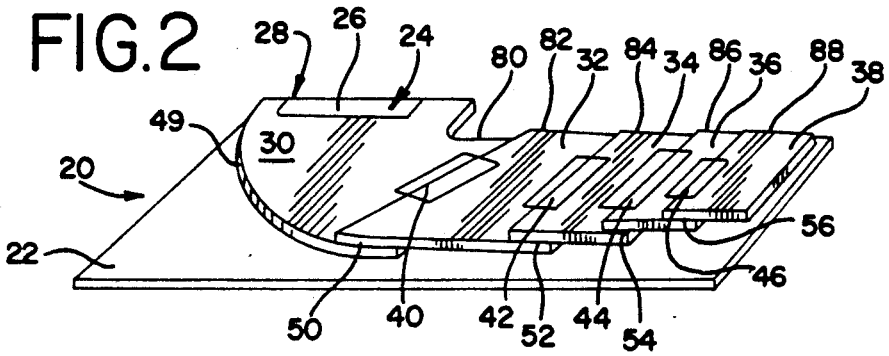
FIG. 2 is a perspective view of one embodiment of a fabric-forming apparatus constructed in accordance with the principles of the present invention which is particularly useful in forming the valence arrangement of FIG. 1.
Figure 7:
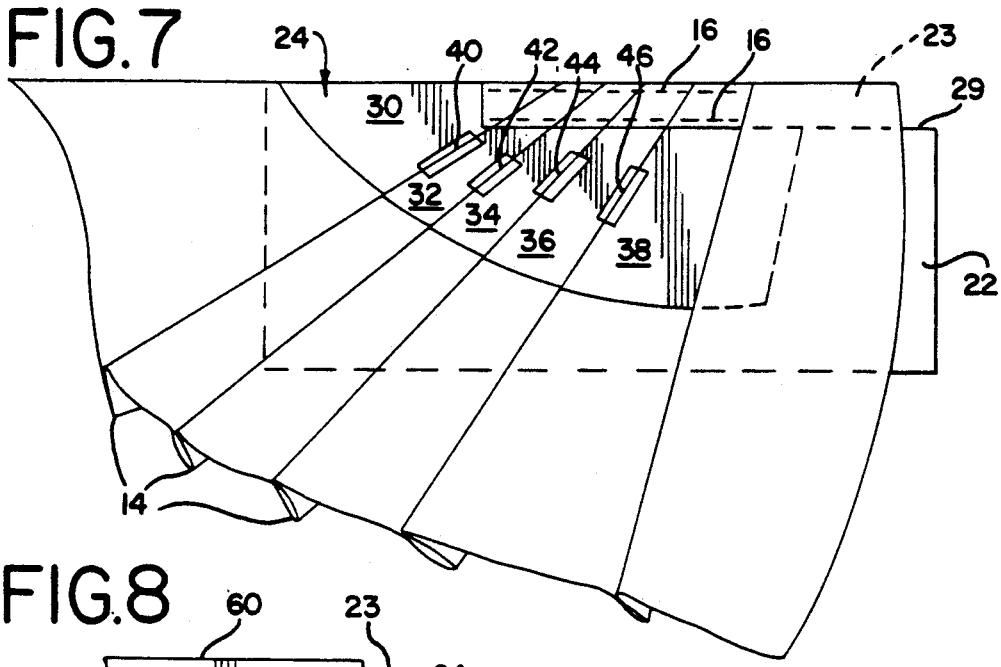
FIG. 7 is a generally plan view of the fabric-forming apparatus of FIG. 2 showing the fabric structure in place within subsequent forming components (with a last component removed for clarity)
Figure 8:
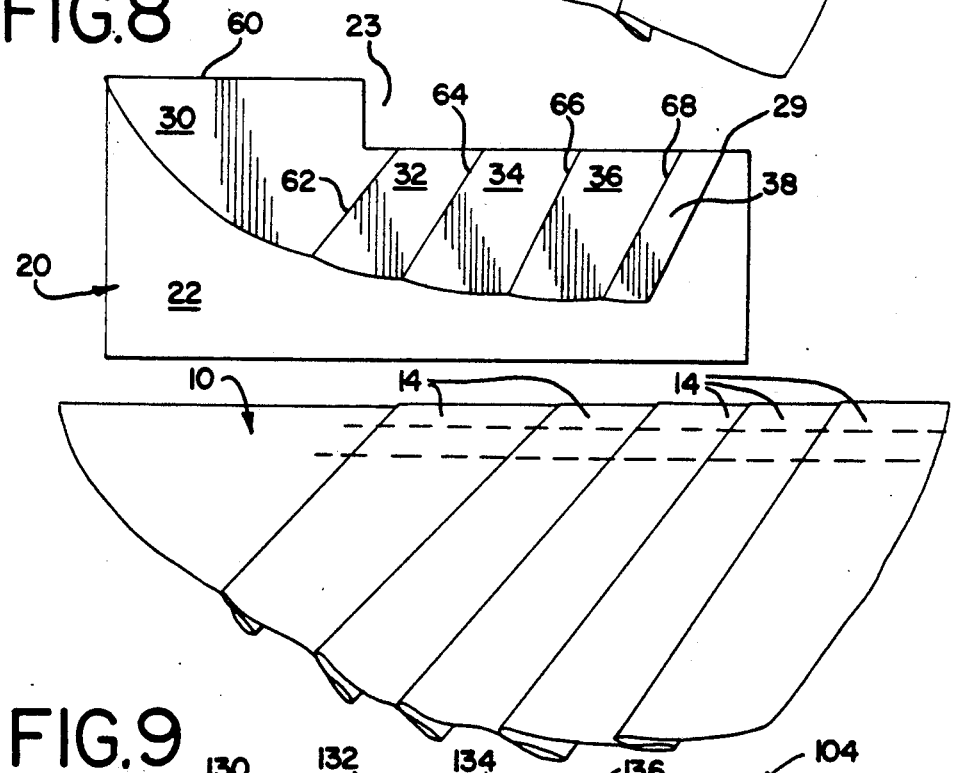
FIG. 8 is a plan view showing removal of the valence arrangement from the fabric-forming device of FIG. 2.

Turning now to FIGS. 2, 7 and 8, the forming member will be explained in greater detail. The forming member 24 is segmented and includes a plurality of generally planar forming components, or templates, 30–38. The templates are interconnected to each other by hinges 40–46 in an overlapping fashion such that each template overlies a portion of its preceding template and a portion on the baseplate 22. In this manner a series of successive fabric-receiving "pockets" 50–56 are defined between corresponding adjacent templates 30–38. Each template 30–38 has an irregular configuration and further includes respective leading edges 60–68 and trailing edges 70–78 disposed on opposite ends thereof. The templates 30–38 have their associated hinges 40–46 disposed along the leading edges thereof such that the intersection of each leading edge 60–68 and the preceding template define a series of "apexes" against which the fabric is folded upon itself. The trailing edges 70–78 of the templates 30–38 remain free and define guidelines or guide edges along which the fabric is folded onto the templates 30–38.

The operational characteristics of the fabric-forming apparatus 20 are best explained by way of discussion of the iterative steps necessary for forming the valence arrangement shown in FIG. 1. Initially, the pleat widths, $w_1$–$w_5$, are predetermined and the templates 30–38 are cut to widths and crease lines corresponding to those desired in the finished fabric structure. The plates are hinged together, such as by a reinforced adhesive tape means when the templates 30–38 are formed from a plastic or, for example, by a suitable mechanical piano hinge in instances where the templates are formed from a sheet metal.

Figure 3:
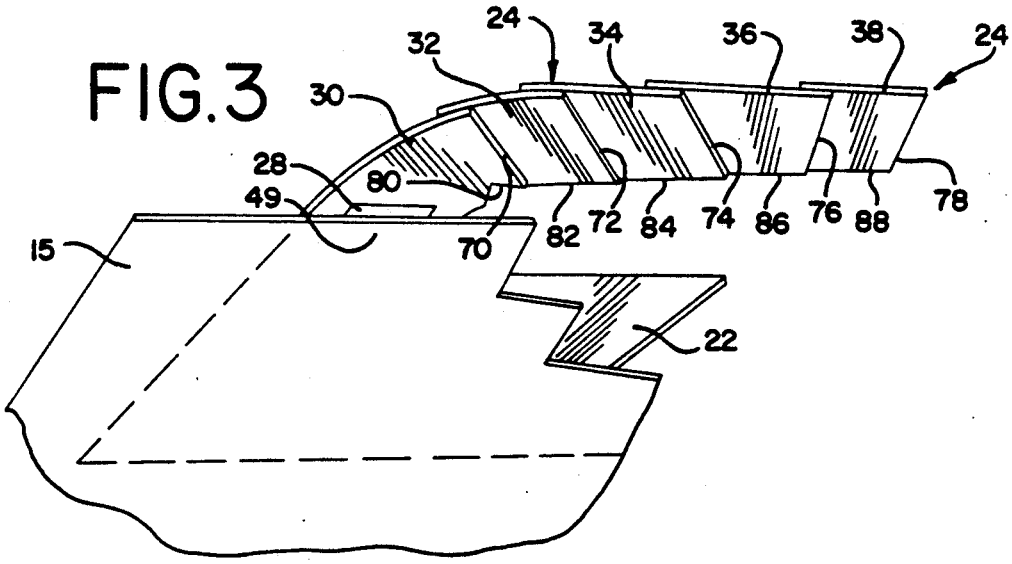
FIG. 3 is a generally plain view of the fabric-forming apparatus of FIG. 2 showing the segmented forming member positioned away from the baseplate and a fabric length aligned in place on the baseplate.

A quantity of fabric 15 of a predetermined length is placed on the baseplate 22 and aligned with the alignment edge 28 of the baseplate 22. (FIG. 3.) The fabric 15 may be premeasured and the various pleat foldlines formed therein by heat setting prior to assembly, although such foldline definitions are not mandatory. The fabric top edge 16 is aligned against the baseplate alignment edge 28 and also against the leading edge 60 of the first template 30. (FIG. 3.) As illustrated the baseplate 22 may be provided with a recess, or cutout area 23, proximate to the baseplate alignment edge 28 to define a second, or additional, baseplate alignment edge 29 which is generally parallel to the first alignment edge 28. This cutout area 23 provides an area in which the fabric assembler may operate a sewing machine, with the second alignment edge 29 serving as a guide edge to run the foot of the sewing machine against.

Figure 4:
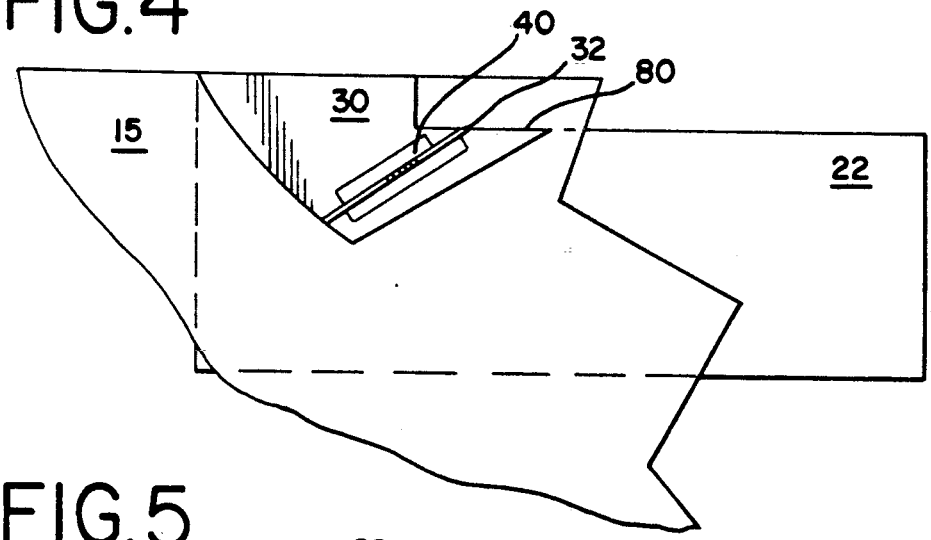
FIG. 4 is a generally plan view of the fabric-forming apparatus of FIG. 2 (with some of the components removed) showing a first component of the segmented forming member folded over onto the fabric and baseplate.
Figure 5:
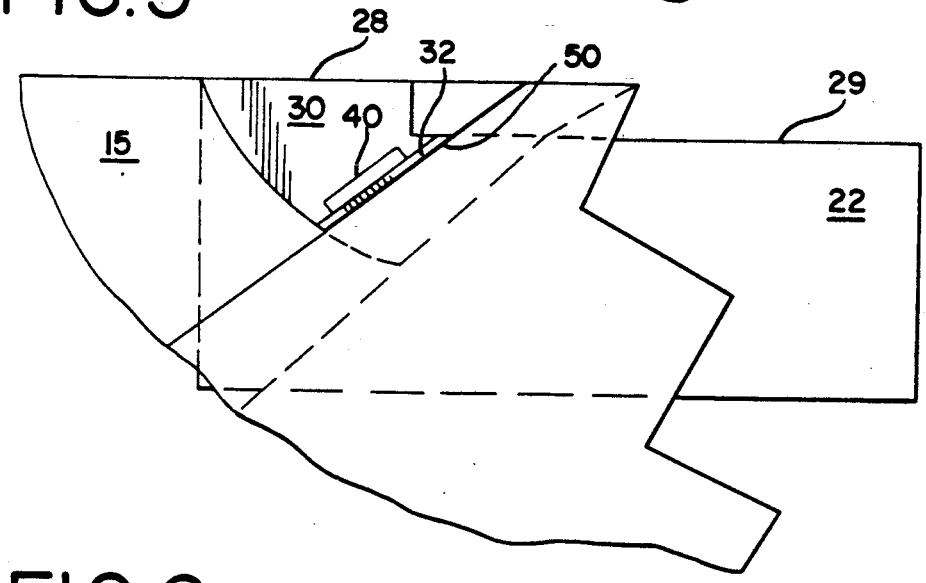
FIG. 5 in a generally plan view of the fabric-forming apparatus of FIG. 4 showing the fabric being folded upon itself within the pocket formed between adjacent forming components.
Figure 6:
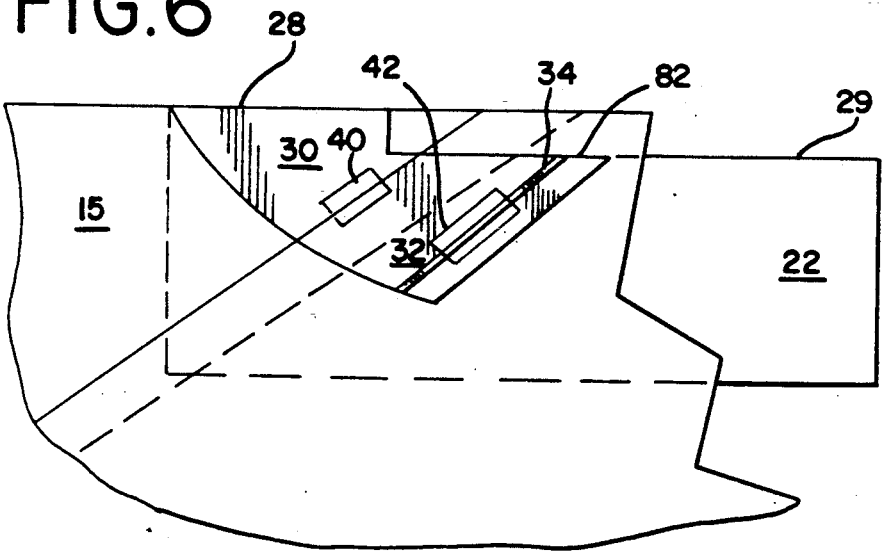
FIG. 6 is a generally plan view of the fabric-forming apparatus of FIG. 5 (with some of the components removed) showing the second, or subsequent forming component being folded over the fabric.

After the fabric 15 is registered in place on the baseplate 22, the first template 30 is folded over the baseplate 22 and fabric 15. (FIG. 4.) The first template 30 is hinged at its leading edge 60 to the baseplate alignment edge 28 to form a pocket 49 therebetween in which the fabric is held. In this regard, the first template 30 has a trailing edge 70 which is coincident with the first crease line of the fabric 15. In instances where the fabric is not creased prior to assembly, the creaseline may be imparted to the fabric when the fabric 15 is folded up against the template 30. The fabric 15 is folded up against the first template trailing edge 70 and onto the first template 30 until the next crease line is coincident with the apex of the pocket 50 formed by the intersection of the first and second templates 30 and 32. The fabric creaseline abuts the leading edge 62 of the second template 32 and the second template 32 is then folded onto the fabric 15 as shown in FIG. 6. The fabric 15 is then again folded up against the second template trailing edge 72 and further folded onto itself to create another fabric fold. The sequence of steps are then repeated for successive templates such that successive leading edges serve as guides against which the fabric 15 is folded onto itself and successive trailing edges serve as guides against which to fold the fabric onto the templates, as shown in FIG. 7. In FIG. 7, a last template has been omitted for clarity purposes, which template would normally cover the last exposed pleat.

When all the plates 14 are formed, they are stitched together within the cutout area 23 along stitch lines 16 to fix the pleats 14 within the fabric structure 10. To further accommodate the stitching of the pleats 14, each template may also preferably include its own alignment edge 80–88 which are aligned with the baseplate second alignment edge 29. These template alignment edges also assist in assembly of the device 20. After stitching, the fabric arrangement 10 may be easily removed from the forming device 20 by pulling it sideways, or to the right, as shown in FIG. 8. Another fabric arrangement having pleats uniform in width to those of the fabric arrangement 10 just formed may be made by following repeating the steps recited above.

Figure 9:
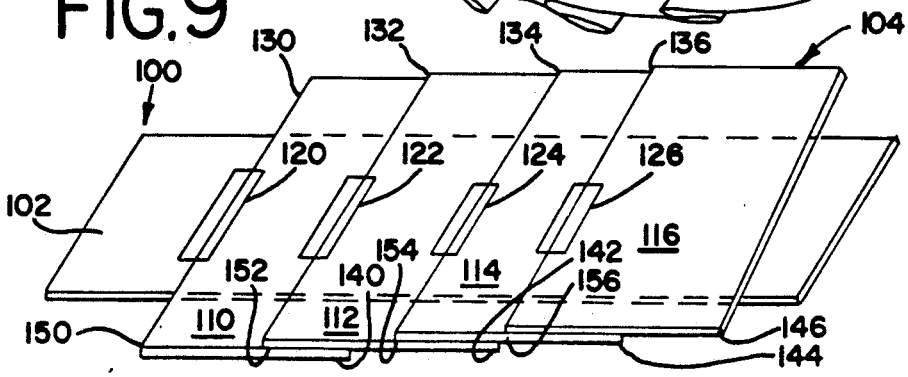
FIG. 9 is a perspective view of a second embodiment of a fabric-forming apparatus constructed in accordance with the principles of the present invention which is particularly suitable for parallel pleating.

Another embodiment 100 of a fabric-guide device constructed in accordance with the principles of the present invention is generally shown in FIG. 9. This device 100 is particularly suitable for use in forming parallel pleats in a fabric structure. Similar to the first embodiment 20 described above, the device 100 includes a base component, or baseplate, 102 and a segmented upper component, or forming member, 104 having four templates 110–116 flexibly interconnected, as by hinges 120–126 in an overlapping fashion whereby each subsequent template overlies a portion of the preceding template and a portion of the baseplate 102. Each of the four templates 110–116 have a generally rectangular configuration with associated leading edges 130–136 which define respective pockets 150–156 between adjacent templates. Trailing edges 140–146 are disposed opposite the leading edges 130–136.

Figure 10:
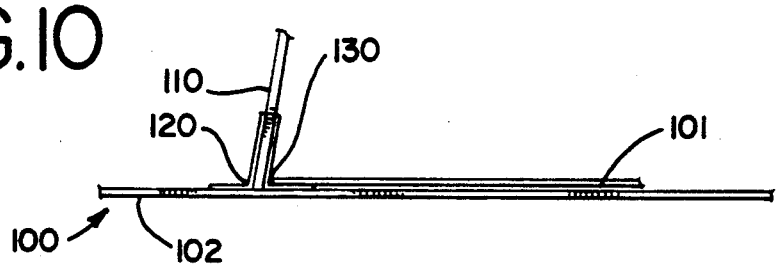
FIG. 10 is an elevational view of the fabric-forming apparatus of FIG. 9 showing the step of aligning the fabric therewithin.
Figure 11:
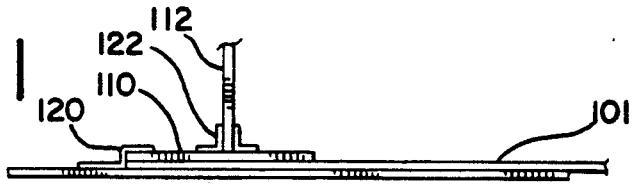
FIG. 11 in an elevational view of the fabric forming apparatus of FIG. 9 showing the step of folding a first template onto the fabric.
Figure 12:
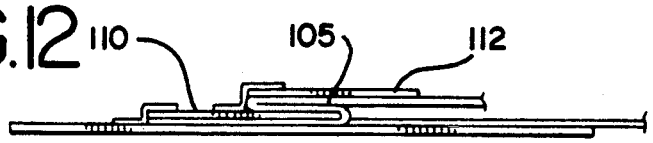
FIG. 12 is an elevational view of the fabric forming apparatus of FIG. 9 showing the step of folding the fabric around the first template to form a pleat.
Figure 13:
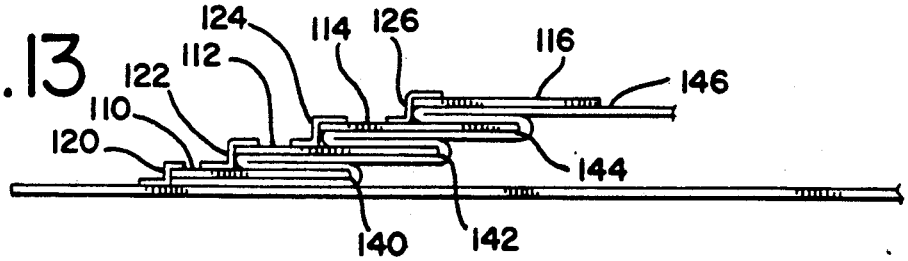
FIG. 13 is an elevational view of the fabric forming apparatus of FIG. 9 showing the step of folding a successive template onto the fabric and first template.
Figure 14:
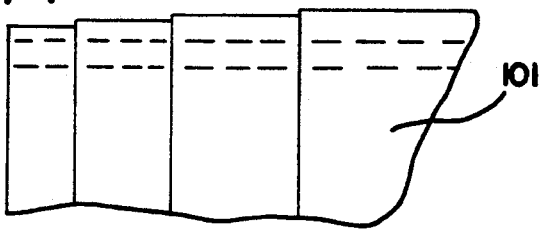
FIG. 14 is an elevational view of the pleated fabric structure after removal from the fabric-forming apparatus of FIG. 9.

The forming member 104 is folded back prior to assembly and the fabric 101 is aligned on the baseplate 102 against the leading edge 130 of the first template 110. (FIG. 10.) The first template 110 is folded onto the fabric 101 (FIG. 11.) and the fabric 101 is then folded up against the first template trailing edge 140 onto itself to form a first pleats 105. The second template 112 is then folded down onto the fabric pleat 105 and the fabric 101 is then folded up against the second template trailing edge 142 and these steps are repeated for successive templates until the final number of pleats are made in the fabric and it is stitched.

Figure 15:
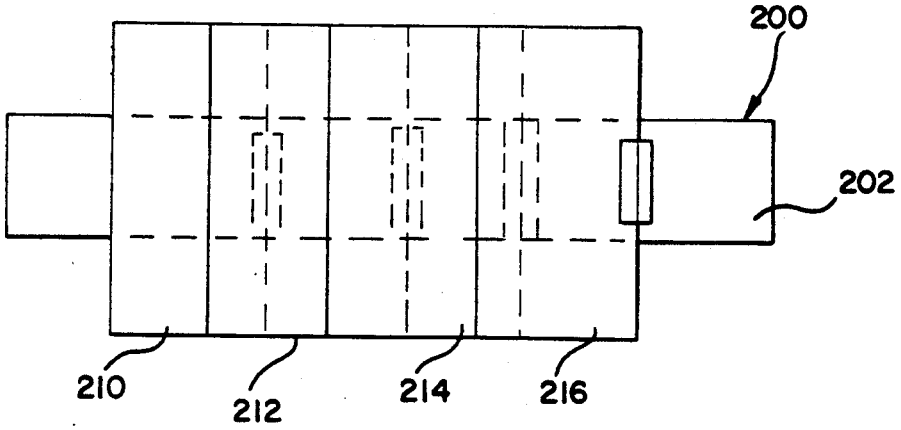
FIG. 15 is a perspective view of a folder-spacer member particularly suitable for use with the fabric-forming device of FIG. 9; and, FIGS. 16A–B are two elevational plan views of the folder-spacer device of FIG. 15 used in conjunction with the fabric-forming device of FIG. 9.
Figure 16A:
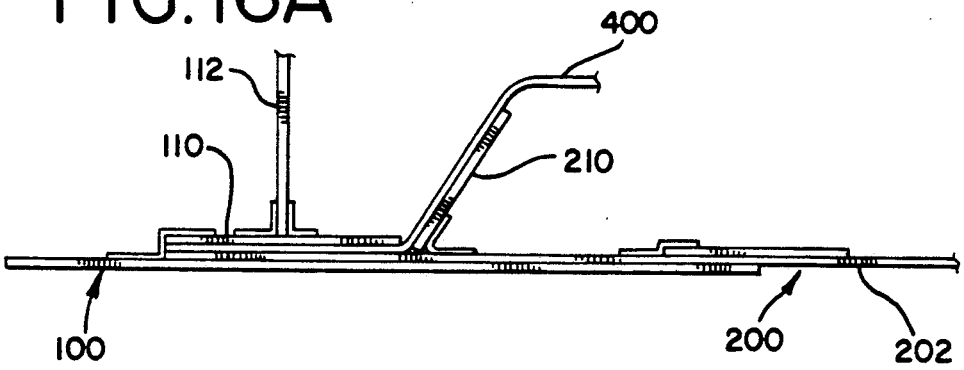
Figure 16B:
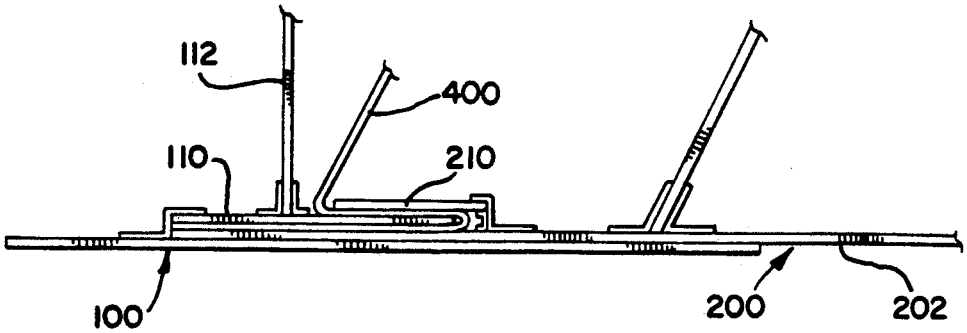

FIG. 15 shows an additional "folder" member 200 which is useful to use with the forming device 100 when heavyweight or bulky fabrics are being pleated. The folder 200 includes a base portion 202 and a series of folder-spacer plates 210–216 which are hinged to the base 202. In use, the folder 200 is positioned adjacent the pleating device 100 so that the heavy fabric 400 is aligned with the leading edge 130 of the first template 110. (FIG. 16A.) The first template 110 is folded onto the fabric 101 and then the first folder-spacer plate 210 is used to support and fold the heavy fabric 400 onto itself and the first template 110. (FIG. 16B.) The second template 112 is then folded onto the fabric 400 and the sequence of steps above are repeated for successive guide and spacer plates.

It will be appreciated that although the various embodiments of the present invention have been illustrated and described as having a certain number of forming components, or templates, it will be understood that the present invention is not limited to any specific number of the same. Rather, the number of templates used in the guide device will preferably correspond to the number of pleats desired in the finished fabric.

It will further be appreciated that the foregoing description is merely illustrative of the principles of the present invention. Numerous modifications may be made by those skilled in the art without departing from the true spirit or scope of the invention.

I claim:

1. An apparatus for use in the forming of pleats within a fabric structure, such as a drapery or curtain arrangement, the apparatus comprising: a base member and a segmented forming member overlying the base member and hingedly connected thereto, said base member defining a baseplate having at least one alignment edge disposed thereon, the segmented forming member including a first template and at least one second template, the first template having a leading edge and a trailing edge, the second template also having a leading edge and a trailing edge, the first template being hingedly connected to said baseplate such that at least a portion of said first template overlies a portion of said baseplate, and said at least one second template being hingedly connected to said first template such that one portion of said at least one second template overlies a portion of said and another portion of said at least one second template overlies a portion of said first template baseplate to thereby form a pocket between said first and at least one second template, the pocket being adapted to receive a predetermined amount of fabric therein, the leading edge of said at least one second template defining an apex of said pocket along which said fabric may be folded upon itself.

2. The apparatus of claim 1, wherein said segmented forming member includes a plurality of additional templates.

3. The apparatus of claim 2, wherein said plurality of additional templates are hingedly connected together.

4. The apparatus of claim 1, wherein said at least one second template is hingedly connected to said first template along said at least one second template leading edge.

5. The apparatus of claim 1, wherein said at least one second template trailing edge defines a fold line of a fabric structure inserted into said pocket.

6. The apparatus of claim 1, wherein said at least one second template is hingedly connected to said first template along said at least one second template leading edge and wherein said at least one second template leading edge defines a fold line of said pocket, the pocket fold line receiving a fabric structure therein.

7. The apparatus of claim 1, wherein said baseplate includes a cutout portion having an additional alignment edge, the baseplate additional alignment edge being disposed generally parallel to said baseplate alignment edge.

8. The apparatus of claim 7, wherein said at least one second template includes an alignment edge which is generally aligned with said baseplate additional alignment edge.

9. The apparatus of claim 1, wherein said baseplate includes a cutout portion, the cutout portion defining a second alignment edge of said baseplate which is disposed generally parallel to said baseplate alignment edge and wherein said segmented forming member includes a plurality of additional templates, each of said plurality of additional templates including an alignment edge which is aligned with said baseplate alignment edge whereby said segmented forming member extends for a predetermined length along said baseplate second alignment edge.

10. The apparatus of claim 1, wherein said first and second templates are generally rectangular.

11. The apparatus of claim 1, wherein said first and second templates have a general irregular perimetrical configuration.

12. The apparatus of claim 1, wherein said first and at least one second template leading and trailing edges are generally parallel.

13. The apparatus of claim 1, wherein said first and at least one second template leading and trailing edges are generally non-parallel.

14. The apparatus of claim 1, further including a folding member including a baseplate and a plurality of folding templates hingedly connected thereto, each of the folding templates having opposed leading and trailing edges, said folding templates being attached to said folder baseplate along said leading edges thereof, said folding baseplate engaging said base member such that said folding templates are spaced apart from said segmented forming member first template and said at least one second template, said folding template trailing edges being adapted to be received along said leading edges.

15. A fabric-forming device for forming multiple non-parallel pleats within a fabric structure in which the fabric is folded upon itself, the device comprising:

a generally planar baseplate, the baseplate having a first alignment edge disposed thereon, said baseplate further having a second alignment edge disposed thereon, the baseplate second alignment edge being disposed generally parallel to the baseplate first alignment edge, and a segmented forming member flexibly connected to said baseplate, the segmented forming member including a primary formplate and at least one secondary formplate, each of the primary formplate and the at least one secondary formplate having a distinct leading edge and a trailing edge, the primary formplate leading and trailing edges being separated by an alignment edge, the at least one secondary formplate leading and trailing edges being separated by a intervening alignment edge, said primary formplate being hingedly connected to said baseplate between said baseplate first alignment edge and said primary formplate leading edge, such that said primary formplate overlies a portion of said baseplate to thereby form a pocket between said baseplate and said primary formplate, the pocket being adapted to hold a predetermined amount of fabric in place therebetween, said at least one secondary formplate being hingedly connected to said primary formplate at said at least one secondary formplate leading edge such that at least one portion of said at least one secondary formplate overlies a portion of said primary formplate and another portion of said at least one secondary formplate overlies a portion of said baseplate, said at least one secondary formplate being hingedly connected to said primary formplate between said at least one secondary formplate leading edge and said primary formplate trailing edge to thereby form a second pocket between said primary formplate and said at least one secondary formplate adapted to receive a folded portion of a fabric therebetween, said at least one secondary formplate leading edge defining a line of reference along which to fold said fabric and thereby form a pleat in said fabric, said at least one secondary formplate alignment edge being generally aligned with said baseplate second alignment edge.

16. The fabric forming-device of claim 15, further including three additional formplates hingedly connected together in overlying relationship to said secondary formplate.

17. The fabric forming-device of claim 15, wherein said baseplate, primary formplate and said at least one secondary formplate are formed from a plastic.

18. The fabric-forming device of claim 15, further including an additional formplate having a leading and trailing edge separated by an alignment edge, the additional formplate being hingedly connected to said at least one formplate along the leading edge thereof, such that a portion of said additional secondary formplate overlies a portion of said at least one formplate and another portion of said additional secondary formplate overlies said baseplate, thereby forming a third pocket between said additional formplate and said at least one secondary formplate which is adapted to receive a folded portion of said fabric.

19. The fabric-forming device of claim 15, wherein said primary formplate and said at least one secondary formplate have irregular configurations.

20. The fabric-forming device of claims 15, further including a plurality of additional templates.

21. The fabric-forming device of claim 15, wherein said primary formplate and said at least one secondary formplate are generally rectangular.

22. The fabric-forming device of claim 15, further including a spacer member having a baseplate and a plurality of spacer plates hingedly connected to said baseplate, each of the spacer plates having an open edge which is received by a corresponding pocket in said fabric-forming device.

23. A method for forming pleats, folds, tucks and the like in fabrics, the method comprising the steps of:

providing a forming device having a baseplate and a series of forming templates hingedly interconnected to each other and to the baseplate;

aligning an edge of a predetermined length of fabric with an alignment edge of said baseplate;

folding a first template down over the fabric length to expose a guide edge of said first template;

folding said fabric length up against the guide edge of said first template and further folding said fabric length upon itself to define a fabric first creaseline and aligning the creaseline with a hinged edge of a second template;

folding the second template over said fabric length to expose a guide edge of said second template; and, folding said fabric length up against said second template guide edge and further folding said fabric length upon itself to define a fabric second creaseline and aligning the second creaseline with a reference point or said second template.

24. The method of claim 23, further including the step of stitching said fabric length to form permanent pleats therein.

* * * * *